US009896848B1

(12) United States Patent
Tontz

(10) Patent No.: US 9,896,848 B1
(45) Date of Patent: Feb. 20, 2018

(54) COLLAPSIBLE SAFETY RAILING

(71) Applicant: Michael A. Tontz, Coronado, CA (US)

(72) Inventor: Michael A. Tontz, Coronado, CA (US)

( * ) Notice: Subject to any disclaimer, the term of this patent is extended or adjusted under 35 U.S.C. 154(b) by 0 days.

(21) Appl. No.: 15/232,665

(22) Filed: Aug. 9, 2016

(51) Int. Cl.
*E04F 11/18* (2006.01)
*E04G 5/04* (2006.01)
*E04G 5/14* (2006.01)

(52) U.S. Cl.
CPC ..... *E04F 11/1865* (2013.01); *E04F 11/1812* (2013.01); *E04F 11/1834* (2013.01); *E04G 5/142* (2013.01); *E04F 2011/187* (2013.01); *E04F 2011/1889* (2013.01)

(58) Field of Classification Search
CPC ..... E04F 11/06; E04F 11/068; E04F 11/1812; E04F 11/1834; E04F 11/1846; E04F 11/1861; E04F 11/1864; E04F 2011/187; E04F 2011/1889; E04F 11/1865; E04G 5/142; E04G 25/04; Y10T 403/32467–403/32524
USPC ..... 256/59, 67; 403/109.1–109.8
See application file for complete search history.

(56) References Cited

U.S. PATENT DOCUMENTS 1,416,957 A * 5/1922 Hughes ..... E04F 11/1834 256/22
3,788,608 A * 1/1974 Raymond ..... E04F 11/18 256/59
9,470,013 B2 * 10/2016 Munyon ..... E04H 17/1421
2013/0277634 A1 * 10/2013 Munyon ..... E04H 17/1421 256/67
2014/0054530 A1 * 2/2014 Petta ..... E04H 17/1421 256/67

OTHER PUBLICATIONS

Safety Edge Protection—Telescopic Handrail. Integrity Worldwide Inc. Oct. 17, 2012. YouTube video retrieved from the Internet: <URL: https://www.youtube.com/watch?v=wDls0MY4Ej4>.*

* cited by examiner

*Primary Examiner* — Josh Skroupa
(74) *Attorney, Agent, or Firm* — Nydegger & Associates

(57) ABSTRACT

A temporary guardrail for an unprotected staircase is assembled and installed using prefabricated sections. One section is a safety section that includes an adjustable length upper railing, with a pair of balusters respectively hinged to each end of the upper railing. Another section is a support section having an adjustable length lower railing that is engaged between the balusters of the safety section and which, when assembled with the safety section, is oriented parallel to the upper railing. The safety and support sections are then stiffened to account for an incline angle α that is defined by the staircase. Also included are structures which can be engaged with the temporary guardrail to stabilize it on the staircase.

15 Claims, 2 Drawing Sheets

COLLAPSIBLE SAFETY RAILING

FIELD OF THE INVENTION

The present invention pertains generally to safety barriers that are useful for protecting workers at construction sites. More particularly, the present invention pertains to temporary structures that can be installed on staircases, which are located inside/outside a building during construction, to help prevent workers from falling off an otherwise unprotected staircase during the construction of the building. The present invention is particularly, but not exclusively, useful as a temporary guardrail having prefabricated sections which can be assembled and installed on a staircase at a construction site, and then disassembled after use for removal and subsequent use at another construction site.

BACKGROUND OF THE INVENTION

Whether the use of safety equipment is required at a construction site to prevent death or injury is always a paramount concern. Of particular concern here is the hazard that is presented when a staircase is being constructed for a building, and is to be used during construction, but which remains unprotected for extended periods of time. Specifically, the hazardous condition is created when such staircases have no guardrails to prevent workers from falling off the otherwise unprotected staircase.

Heretofore, when it has been recognized that a guardrail is essential for an unprotected staircase at a construction site, the needed guardrail has been typically constructed using on-site materials. Subsequently, when the temporary guardrail is to be replaced, or is no longer needed, the materials that were used for constructing the guardrail are merely discarded.

With the above in mind, it is an object of the present invention to provide a temporary guardrail for an otherwise unprotected staircase, using prefabricated sections, which can be assembled on site and installed on the staircase. Another object of the present invention is to provide a temporary guardrail for an unprotected staircase which can be disassembled after use, removed from a construction site, and then reused at another construction site. Still another object of the present invention is to provide prefabricated sections for a temporary guardrail, wherein the individual sections of the guardrail can be reconfigured into compact units to facilitate transport between different construction sites. Yet another object of the present invention is to provide a temporary guardrail for a staircase which is easy to assemble, is simple to install, and is comparatively cost effective.

SUMMARY OF THE INVENTION

In accordance with the present invention, a temporary guardrail for an unprotected staircase is provided which includes prefabricated sections that can be assembled and installed for use. After use, the guardrail can be disassembled and reconfigured for transport for reuse at a different site. As envisioned for the present invention, the staircase defines an incline angle $\alpha$ which is accounted for in the assembly of the guardrail.

Structurally, the present invention includes a safety section, a support section, and a stabilizing section which are assembled together to create the guardrail. In detail, the safety section includes an elongated upper railing having a first end and a second end. Also included in the safety section is a bottom baluster having a first end and a second end, with the first end of the bottom baluster hinged to the first end of the upper railing. Further, the safety section includes a top baluster having a first end and a second end. Similar to the bottom baluster, the first end of the top baluster is hinged to the second end of the upper railing.

The support section of the temporary guardrail includes an elongated lower railing having a first end and a second end. For an assembly of the guardrail, the first end of the lower railing is engaged with the bottom baluster, and its second end is engaged with the top baluster. With this engagement the lower railing is positioned parallel to the upper railing. Importantly, in this combination, both the lower railing and the upper railing are respectively oriented relative to the bottom baluster and the top baluster by the incline angle $\alpha$. Further, wing nuts are provided for engaging the lower railing with the bottom baluster and with the top baluster. The wing nuts can then be used to tighten these engagements, to thereby stiffen the combination of the safety section with the support section. Also included in the support section is an attachment pad for affixing the second end of the bottom baluster to a bottom step of the staircase. Similarly, an attachment pad is used for affixing the second end of the top baluster to a top step of the staircase.

The stabilizing section of the guardrail includes an upper support member having a first end and a second end, with a bracing pad swivel mounted at its first end for abutment against a ceiling structure above the guardrail. The stabilizing section also includes a lower support member having a first end and a second end, with a peg pad swivel mounted at its second end for engagement of the peg with the upper railing of the safety section. Additionally, an adjuster is engaged between the second end of the upper support member and the first end of the lower support member. During an installation of the guardrail, manipulation of the adjuster causes the bracing pad to push against the ceiling structure, and force the peg pad into engagement with the upper railing. The intended consequence of manipulating the adjuster is to stabilize the guardrail on the staircase.

As intended for the present invention, the upper railing, the bottom baluster and the top baluster of the safety section, as well as the lower railing of the support section, each respectively comprises a plurality of telescopingly interactive concentric tubes. Further, each tube has a length and is rectangular shaped, it is also hollow and each tube is formed with a plurality of holes aligned along the length of the tube. Within this structure, pins can be inserted through aligned holes between pairs of concentric tubes to fix a relationship between tubes in the pair. Also, the wing nuts which are used to engage the lower railing with the safety section can be tightened to stiffen the upper railing, the lower railing, the bottom baluster and the top baluster into a predetermined configuration with each other.

As an additional safeguard for the guardrail of the present invention, a netting can be used with the guardrail. When used, the netting can be supported on the combined safety section and support section to extend between the upper railing and the lower railing, and between the bottom baluster and the top baluster.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
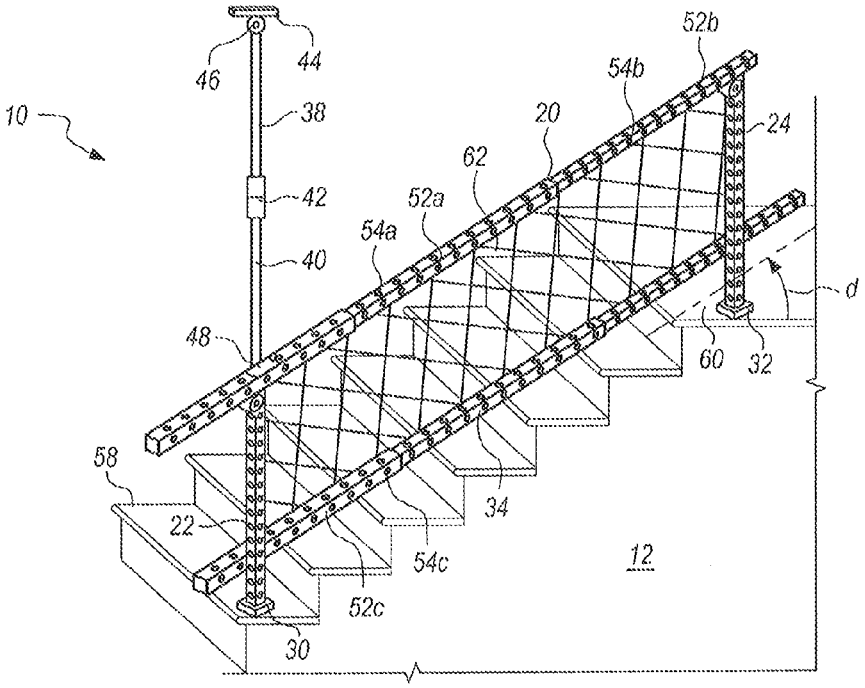
FIG. 1 is a perspective view of the temporary guardrail of the present invention when it has been installed on a staircase.

Initially referring to FIG. 1, a guardrail in accordance with the present invention is shown and is generally designated 10. In FIG. 1, the guardrail 10 is shown assembled and installed on a staircase 12. A more comprehensive structural appreciation of the guardrail 10, however, will be had by cross-referencing FIG. 1 with FIG. 2.

Figure 2:
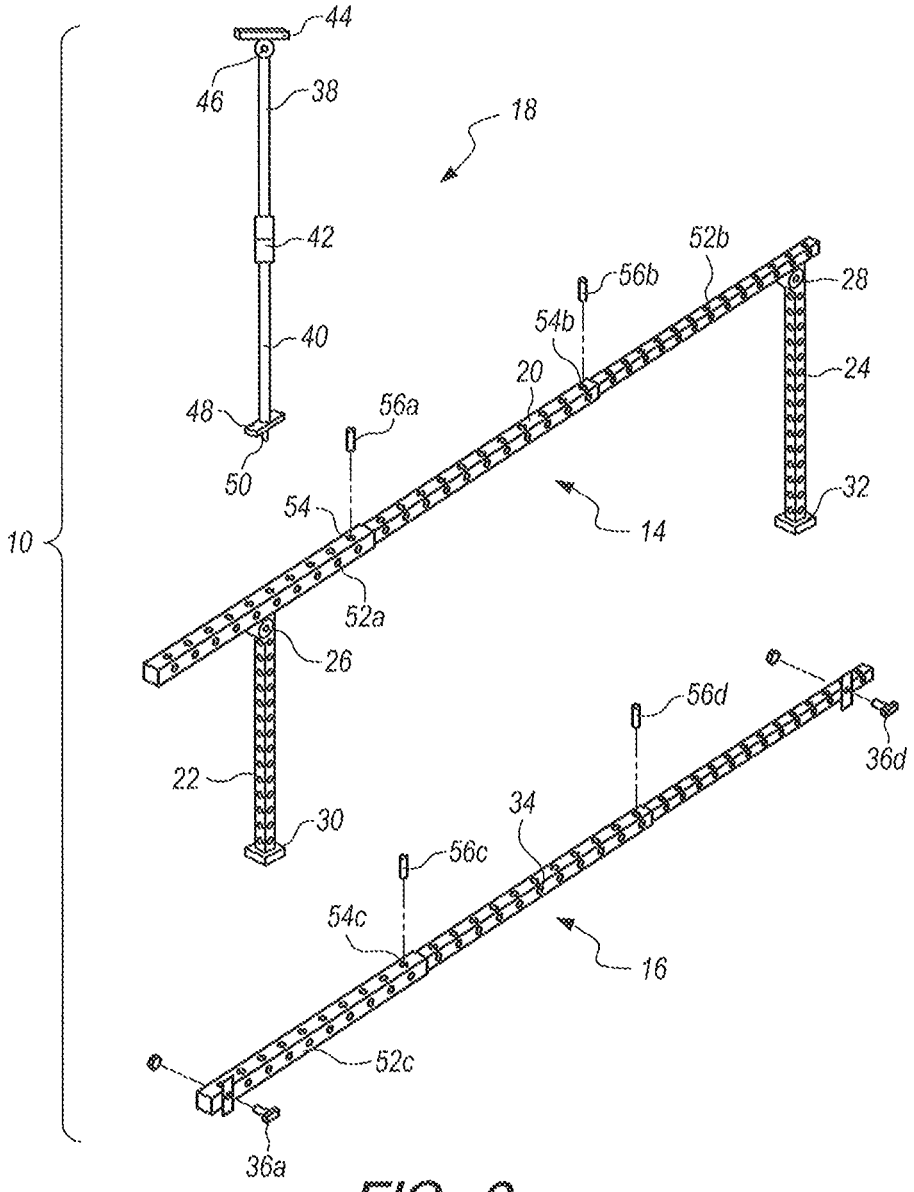
FIG. 2 is an exploded view of the temporary guardrail of the present invention showing the prefabricated sections of the guardrail in their relative positions for assembly.

With reference to FIG. 2 it will be seen that the guardrail 10 essentially includes three prefabricated sections. They are: a safety section 14, a support section 16 and a stabilizing section 18.

In detail, FIGS. 1 and 2 show that the safety section 14 includes, in combination, an upper railing 20, a bottom baluster 22, and a top baluster 24. A hinge 26 interconnects the bottom baluster 22 with the upper railing 20, and a hinge 28 interconnects the top baluster 24 with the upper railing 20. Also, it will be seen that an attachment pad 30 is provided for the bottom baluster 22 and, similarly, an attachment pad 32 is provided for the top baluster 24.

Still referring to FIGS. 1 and 2, the support section 16 is shown to include a lower railing 34 and a pair of wing nuts 36*a* and 36*b*. Specifically, as described in detail below, the wing nuts 36*a* and 36*b* are provided to establish a configuration for the guardrail 10, and to stiffen the guardrail in this configuration.

FIGS. 1 and 2 also show that the stabilizing section 18 (not shown in FIG. 1) includes an upper support member 38 and a lower support member 40. An adjuster 42 interconnects the upper support member 38 with the lower support member 40. Further, the upper support member 38 is shown to include a bracing pad 44 that is mounted on a swivel 46, opposite the adjuster 42, for its connection with the upper support member 38. As for the lower support member 40, a peg pad 48 is formed with a peg 50 and is mounted on the lower support member 40, opposite the adjuster 42.

Several structural considerations are provided for the installation and assembly of the guardrail 10 of the present invention. In particular, the upper railing 20, the bottom baluster 22 and the top baluster 24 of the safety section 14, as well as the lower railing 34 of the support section 16 each include a plurality of tubes 52, of which the tubes 52 *a-c* shown in FIGS. 1, 2, 3 and 4 are only exemplary. Structurally, however, the tubes 52 are similar. In particular, the safety section 14 and the support section 16 respectively include a plurality of telescopingly interactive concentric tubes 52. Each tube 52 has a length and is rectangular shaped. And further, each tube 52 is formed with a plurality of holes 54 that are aligned along the length of the respective tube 52. The holes 54 *a-c* shown in FIGS. 1, 2, 3 and 4 are only exemplary.

As indicated in FIG. 2, the various tubes 52 that are disclosed above can be selectively configured by using pins 56, such as the pins 56 *a-d*. In detail, each pin 56 can be inserted through aligned holes 54 between pairs of concentric tubes 52 to fix a relationship between tubes 52 in the pair. Further, the wing nuts 36 that are used to connect the lower railing 34 with the bottom baluster 22 and to the top baluster 24 can be tightened to stiffen the upper railing 20, the lower railing 34, the bottom baluster 22 and the top baluster 24 into a predetermined configuration with each other.

As indicated in FIG. 1, during assembly of the guardrail 10, the guardrail 10 can be stabilized by fixing the attachment pad 30 of the bottom baluster 22 onto the bottom step 58 of the staircase 12. Also for this purpose, the attachment pad 32 of the top baluster 34 can be fixed onto the top step 60 of the staircase 12. For purposes of the present invention, both pads 30 and 32 can be fixed onto the respective step 58 and 60 by any means well known in the pertinent art.

In addition to the above disclosure, the stabilizing section 18 is specifically intended to provide stability for the guardrail 10. Specifically, this is accomplished by first inserting the peg 50 of the peg pad 48 of the lower support member 40 into a hole 54 on the upper railing 20 of the safety section 14. The bracing pad 44 of the upper support member 38 is then positioned against a ceiling structure (not shown). With the peg pad 50 and the bracing pad 44 in place, the adjuster 42 can then be manipulated to push the bracing pad 44 into contact with the ceiling structure to provide stabilized support for the guardrail 10.

As a further safety measure, a netting 62 can be supported on the combined safety section 14 and support section 16. When in place, the netting 62 will preferably extend between the upper railing 20 and the lower railing 22, and between the bottom baluster 22 and the top baluster 24.

After use of the guardrail 10 at a location (e.g. construction site) is completed, the guardrail 10 can be disassembled by removing the netting 62 from the guardrail 10. The stabilizing section 18 can then be removed between the upper railing 20 and the ceiling structure (not shown). Next, the lower railing 34 of the support section 16 is disengaged from the safety section 14 by removing the wing nuts 36. These actions effectively separate the safety section 14, the support section 16 and the stabilizing section 18 from each other.

Figure 3:
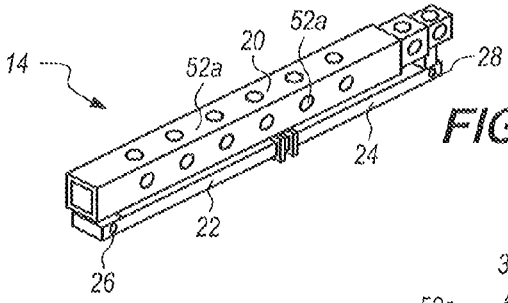
FIG. 3 is a perspective view of the safety section of the temporary guardrail for the present invention in a collapsed and folded configuration to facilitate transport.
Figure 4:
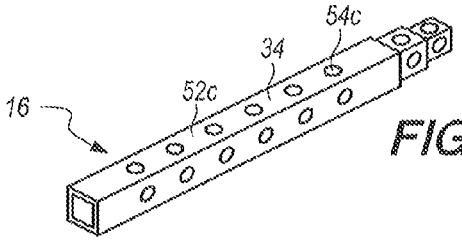
FIG. 4 is a perspective view of the support section of the temporary guardrail for the present invention in a collapsed configuration to facilitate transport.
Figure 5:
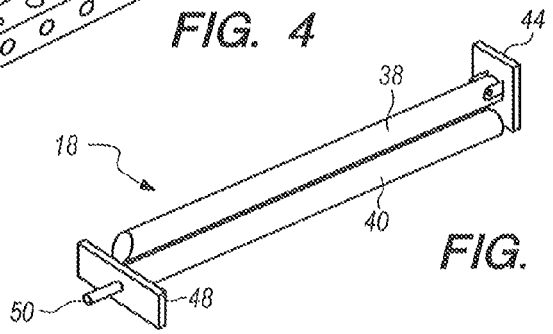
FIG. 5 is a perspective view of the stabilizing section of the temporary guardrail for the present invention in a disassembled configuration to facilitate transport.

Once it is separated, the safety section 14 can be prepared for transport by collapsing the upper railing 20, the bottom baluster 22 and the top baluster 24. The collapsed bottom baluster 22, and the collapsed top baluster 24 can then be folded against the collapsed upper railing 20 for transport as shown in FIG. 3. Similarly, the lower railing 34 can be collapsed for transport as shown in FIG. 4. And, the stabilizing section 18 can be disassembled and prepared for transport as shown in FIG. 5.

While the particular Collapsible Safety Railing as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A temporary guardrail for an unprotected staircase wherein the staircase defines an incline angle α, and the guardrail comprises:

a safety section including an elongated upper railing having a first end and a second end, a bottom baluster having a first end and a second end with the first end thereof hinged to the first end of the upper railing, and a top baluster having a first end and a second end with the first end thereof hinged to the second end of the upper railing;

a support section including an elongated lower railing having a first end and a second end with the first end thereof engaged with the bottom baluster and the second end thereof engaged with the top baluster to position the lower railing parallel to the upper railing, and with both the lower railing and the upper railing respectively oriented relative to the bottom baluster and the top baluster by the incline angle α;

a means for affixing the second end of the bottom baluster to a bottom step of the staircase;

a means for affixing the second end of the top baluster to a top step of the staircase;

an upper support member having a first end and a second end, with a bracing pad swivel mounted at the first end thereof for abutment against a ceiling structure above the guardrail;

a lower support member having a first end and a second end, with a peg pad swivel mounted at the second end of the lower support member for engagement of the peg with the upper railing of the safety section; and an adjuster engaged between the second end of the upper support member and the first end of the lower support member to respectively push the bracing pad against the ceiling structure and to force the peg pad into engagement with the upper railing, to stabilize the guardrail on the staircase.

2. The guardrail recited in claim 1 wherein the adjuster comprises a screw-activated tensioner.

3. The guardrail recited in claim 1 wherein the upper railing, the bottom baluster and the top baluster of the safety section, as well as the lower railing of the support section each respectively comprises a plurality of telescopingly interactive concentric tubes, wherein each tube has a length and is rectangular shaped, and each tube is formed with a plurality of holes aligned along the length of the tube.

4. The guardrail recited in claim 3 further comprising:

a plurality of pins, wherein each pin is inserted through aligned holes between pairs of concentric tubes to fix a relationship between tubes in the pair, and to respectively stiffen the upper railing, the lower railing, the bottom baluster and the top baluster into a predetermined configuration with each other; and a plurality of wing nuts for engaging the lower railing with the bottom baluster and with the top baluster.

5. The guardrail recited in claim 4 further comprising a netting supported on the combined safety section and support section, between the upper railing and the lower railing and between the bottom baluster and the top baluster.

6. A temporary guardrail for an unprotected staircase wherein the staircase defines an incline angle α, and the guardrail comprises:

an elongated upper railing having a first end and a second end;

a bottom baluster having a first end and a second end with the first end thereof hinged to the first end of the upper railing;

a top baluster having a first end and a second end with the first end thereof hinged to the second end of the upper railing;

an elongated lower railing having a first end and a second end with the first end thereof engaged with the bottom baluster and the second end thereof engaged with the top baluster to position the lower railing parallel to the upper railing, and with both the lower railing and the upper railing respectively oriented relative to the bottom baluster and the top baluster by the incline angle α;

an upper support member having a first end and a second end, with a bracing pad swivel mounted at the first end thereof for abutment against a ceiling structure above the guardrail;

a lower support member having a first end and a second end, with a peg pad swivel mounted at the second end of the lower support member for engagement of the peg with the upper railing of the safety section; and an adjuster engaged between the second end of the upper support member and the first end of the lower support member to respectively push the bracing pad against the ceiling structure and to force the peg pad into engagement with the upper railing, to stabilize the guardrail on the staircase.

7. The guardrail recited in claim 6 further comprising:

a means for affixing the second end of the bottom baluster to a bottom step of the staircase; and a means for affixing the second end of the top baluster to a top step of the staircase.

8. The guardrail recited in claim 7 wherein the upper railing, the bottom baluster, the top baluster and the lower railing each respectively comprises a plurality of telescopingly interactive concentric tubes, wherein each tube has a length and is rectangular shaped, and each tube is formed with a plurality of holes aligned along the length of the tube.

9. The guardrail recited in claim 8 further comprising:

a plurality of pins, wherein each pin is inserted through aligned holes between pairs of concentric tubes to fix a relationship between tubes in the pair, and to respectively stiffen the upper railing, the lower railing, the bottom baluster and the top baluster into a predetermined configuration with each other; and a plurality of wing nuts for engaging the lower railing with the bottom baluster and with the top baluster.

10. The guardrail recited in claim 9 wherein the lower railing can be collapsed to create a transportable support section unit.

11. The guardrail recited in claim 8 wherein the elongated upper railing, the bottom baluster, and the top baluster, in combination, comprise a safety section, and wherein the upper railing can be collapsed, the bottom baluster can be collapsed and folded around its hinge into a position against the collapsed upper railing, and the top baluster can be collapsed and folded around its hinge into a position against the upper railing to create a transportable safety section unit.

12. A method for installing a temporary guardrail for an unprotected staircase wherein the staircase defines an incline angle α, the method comprising the steps of:

providing a safety section including an elongated upper railing having a first end and a second end, a bottom baluster having a first end and a second end with the first end thereof hinged to the first end of the upper railing, and a top baluster having a first end and a second end with the first end thereof hinged to the second end of the upper railing;

orienting the bottom baluster relative to the upper railing to account for the incline angle α;

orienting the top baluster parallel to the bottom baluster;

providing a support section including an elongated lower railing having a first end and a second end with the first end thereof engaged with the bottom baluster and the second end thereof engaged with the top baluster to position the lower railing parallel to the upper railing, and with both the lower railing and the upper railing respectively oriented relative to the bottom baluster and to the top baluster by the incline angle $\alpha$;

fixedly engaging the lower railing with the bottom baluster, and with the top baluster, to align the lower railing parallel to the upper railing;

providing a stabilizing section including an upper support member having a first end and a second end, with a bracing pad swivel mounted at the first end thereof, and including a lower support member having a first end and a second end, with a peg pad swivel mounted at the second end thereof, and including an adjuster engaged between the second end of the upper support member and the first end of the lower support member; and manipulating the adjuster to push the bracing pad of the upper support member into abutment against a ceiling structure above the guardrail, and to force the peg pad of the lower support member into engagement with the upper railing of the safety section, to stabilize the guardrail on the staircase.

13. The method recited in claim 12 wherein the upper railing, the bottom baluster and the top baluster of the safety section, as well as the lower railing of the support section each respectively comprises a plurality of telescopingly interactive concentric tubes, wherein each tube has a length and is rectangular shaped, and each tube is formed with a plurality of holes aligned along the length of the tube.

14. The method recited in claim 13 further comprising the steps of:

inserting pins through respectively aligned holes between pairs of concentric tubes to fix a relationship between tubes in the pair, to stiffen the upper railing, the lower railing, the bottom baluster and the top baluster into a predetermined configuration with each other;

engaging the lower railing with the bottom baluster and with the top baluster;

affixing the second end of the bottom baluster to a bottom step of the staircase; and affixing the second end of the top baluster to a top step of the staircase.

15. The method recited in claim 14 further comprising the step of supporting a netting on the combined safety section and support section, between the upper railing and the lower railing and between the bottom baluster and the top baluster.

* * * * *